US010758912B1

(12) United States Patent
Guthmiller

(10) Patent No.: US 10,758,912 B1
(45) Date of Patent: Sep. 1, 2020

(54) MATERIAL PROCESSING SYSTEM

(71) Applicant: Gene P. Guthmiller, Medina, ND (US)

(72) Inventor: Gene P. Guthmiller, Medina, ND (US)

( * ) Notice: Subject to any disclaimer, the term of this patent is extended or adjusted under 35 U.S.C. 154(b) by 0 days.

(21) Appl. No.: 16/381,999

(22) Filed: Apr. 11, 2019

(51) Int. Cl.
*B02C 15/00* (2006.01)

(52) U.S. Cl.
CPC ..... *B02C 15/007* (2013.01); *B02C 15/004* (2013.01); *B02C 2015/008* (2013.01)

(58) Field of Classification Search
CPC ..... B02C 15/007; B02C 15/004; B02C 4/32; B02C 4/40; B02C 4/42; B02C 4/44; B02C 15/00; B02C 2015/008
USPC ..... 241/119, 120
See application file for complete search history.

(56) References Cited

U.S. PATENT DOCUMENTS 637,362 A * 11/1899 Trees ..... B02C 15/006 241/120
11,545,332 * 9/1915 Moss ..... B02C 18/148 241/60
1,281,646 A * 10/1918 Park ..... B02C 15/006 241/120
1,806,077 A * 5/1931 McMurray ..... B02C 15/14 241/119
2,135,762 A * 11/1938 Nicholls, Jr. ..... B22C 5/0427 241/128
2,304,326 A * 12/1942 Adams ..... B02C 15/04 241/109
2,533,684 A 12/1950 Newcomb
3,761,025 A * 9/1973 Young ..... B02C 15/14 241/107
4,109,871 A * 8/1978 Lohnherr ..... B02C 15/007 241/19
4,349,158 A * 9/1982 Broman ..... B02C 15/04 241/117
4,485,974 A * 12/1984 Lass ..... B02C 25/00 241/121
4,489,895 A * 12/1984 Petersen ..... B02C 15/007 241/119
4,497,215 A * 2/1985 Gronbech ..... B21B 31/20 72/248
4,869,434 A * 9/1989 Folsberg ..... B02C 15/007 241/34
4,909,450 A * 3/1990 Henne ..... B02C 15/007 241/119
5,895,000 A 4/1999 Shinjo
6,752,696 B2 6/2004 Murai
(Continued)

*Primary Examiner* — Shelley M Self
*Assistant Examiner* — Smith Oberto Bapthelus
(74) *Attorney, Agent, or Firm* — Neustel Law Offices

(57) ABSTRACT

A material processing system for processing and separating material, such as gold or rocks of desired shape and size, from undesired materials. The material processing system generally includes a base, a table rotationally coupled to the base, a drive assembly coupled to the base by a height-adjustment mechanism, and one or more wheels, such as large pneumatic wheels mounted on the drive assembly and positionable so that a portion of the outer surface of the wheels contacts the table. The table may be rotationally coupled to the base by a bearing, and may further be coupled to the bearing by a table support. Material fed onto the table may be crushed beneath the wheels or carried over a plurality of annular grooves as the table rotates, driven by one or more wheels or directly by a motor.

18 Claims, 13 Drawing Sheets

(56) References Cited

U.S. PATENT DOCUMENTS

| | | | | |
|---|---|---|---|---|
| 7,267,293 | B2 * | 9/2007 | Chen | B02C 15/001 241/117 |
| 7,938,349 | B2 * | 5/2011 | Neumann | B02C 15/04 241/121 |
| 8,692,495 | B2 * | 4/2014 | Berger | B02C 25/00 100/121 |
| 2004/0188554 | A1 * | 9/2004 | Levy | B02C 15/00 241/119 |
| 2009/0057450 | A1 * | 3/2009 | Euculano | B02C 15/04 241/107 |
| 2009/0314866 | A1 * | 12/2009 | Hoffmann | B02C 15/04 241/120 |
| 2013/0008989 | A1 * | 1/2013 | Heinemann | B02C 15/007 241/231 |
| 2013/0146694 | A1 * | 6/2013 | Yamaguchi | B02C 15/004 241/117 |
| 2013/0175378 | A1 * | 7/2013 | Kawatsu | B02C 15/004 241/117 |
| 2015/0151304 | A1 * | 6/2015 | Guerrero Palma | B02C 15/007 241/27 |
| 2015/0196923 | A1 * | 7/2015 | Fornefeld | B02C 15/006 241/30 |
| 2015/0201809 | A1 * | 7/2015 | Balasubramanian | A47J 43/06 241/65 |
| 2015/0224512 | A1 * | 8/2015 | Guerrero Palma | B02C 15/007 241/15 |
| 2016/0271615 | A1 * | 9/2016 | Hao | B02C 15/02 |

* cited by examiner

MATERIAL PROCESSING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a material processing system for processing material that may include desired rocks and undesired soft material and rocks, as well as pay dirt that contains gold.

Related Art

Any discussion of the related art throughout the specification should in no way be considered as an admission that such related art is widely known or forms part of common general knowledge in the field.

Rock crushers and material processing systems have been in use for many years that separate undesirable rocks and other materials from the rocks that are desirable and in condition for use in concrete. For example, for rock that is to be used in concrete as an aggregate, soft impurities, soft rocks, and irregularly shaped rocks are undesirable, while clean, hard rocks 1" in size or less, free of coatings of clay or other fine materials, are recommended. Material processing systems have also been used for recovering gold from pay dirt.

Current methods may pulverize all the rock instead of just the soft rock and odd-shaped rocks, and so result in the loss of good rock. In addition, further processing, such as water washing, may also be required.

SUMMARY

An example embodiment is directed to a material processing system. The material processing system includes a base, a table rotationally coupled to the base, a drive assembly coupled to the base by a height-adjustment mechanism, and one or more wheels having an outer surface, the wheels rotationally mounted on the drive assembly and positionable so that a portion of the outer surface of the wheels contacts the table. The table may be rotationally coupled to the base by a bearing, and may further be coupled to the bearing by a table support.

The wheels may be pneumatic, and their give may prevent or limit the excessive crushing of the material being processed. The wheel or wheels may be rotationally driven by the drive assembly, and material on the table will be crushed under the wheel as the table rotates.

In an example embodiment, the rotation of the driven wheel causes the table to rotate. The height-adjusting mechanism may be fixed, or may be adjustable to increase a pressure between the wheel and the table. For example, the height-adjusting mechanism may comprise a hydraulic cylinder, or if adjustable pressure is not needed (such as for refining/washing gold), the mechanism may be a fixed rod or strut. In the embodiment using a hydraulic cylinder, the hydraulic cylinder may be actuated to forcefully pull the wheels down onto the table, so that when the table rotates under the wheels, material on the table moves under the wheels and is crushed. Adjustment of the downward pressure of the wheels is advantageous because it allows the crushing action to accommodate the type of material being fed to the material processing system, preventing waste that could occur by crushing desirable rock under too much pressure, or under unyielding crushing elements.

In an example embodiment, the height-adjusting mechanism may also comprise a double-acting hydraulic cylinder. A double-acting cylinder may be adjustable to lift the wheels off of the table, to allow cleaning, servicing, etc.

Example embodiments of the crushing apparatus may further comprise a hopper having a hopper discharge positioned above the table to feed material to the crushing apparatus. The embodiment may further comprise a conveyor having a conveyor discharge, the conveyor discharge positioned above the hopper to supply material, such as unprocessed rock, to the hopper.

The apparatus may further comprise a scraper or roller positioned above the table to move the material off the table after it has passed under the wheel or wheels. As mentioned above, the wheel may comprise a plurality of wheels, and one wheel may be driven and other wheels may simply roll on the table as it rotates. The driven wheel or wheels may be rotationally driven by the drive assembly, which may include a gearbox and a motor, wherein the motor drives a wheel through the gearbox.

There has thus been outlined, rather broadly, some of the embodiments of the material processing system in order that the detailed description thereof may be better understood, and in order that the present contribution to the art may be better appreciated. There are additional embodiments of the material processing system that will be described hereinafter and that will form the subject matter of the claims appended hereto. In this respect, before explaining at least one embodiment of the material processing system in detail, it is to be understood that the material processing system is not limited in its application to the details of construction or to the arrangements of the components set forth in the following description or illustrated in the drawings. The material processing system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
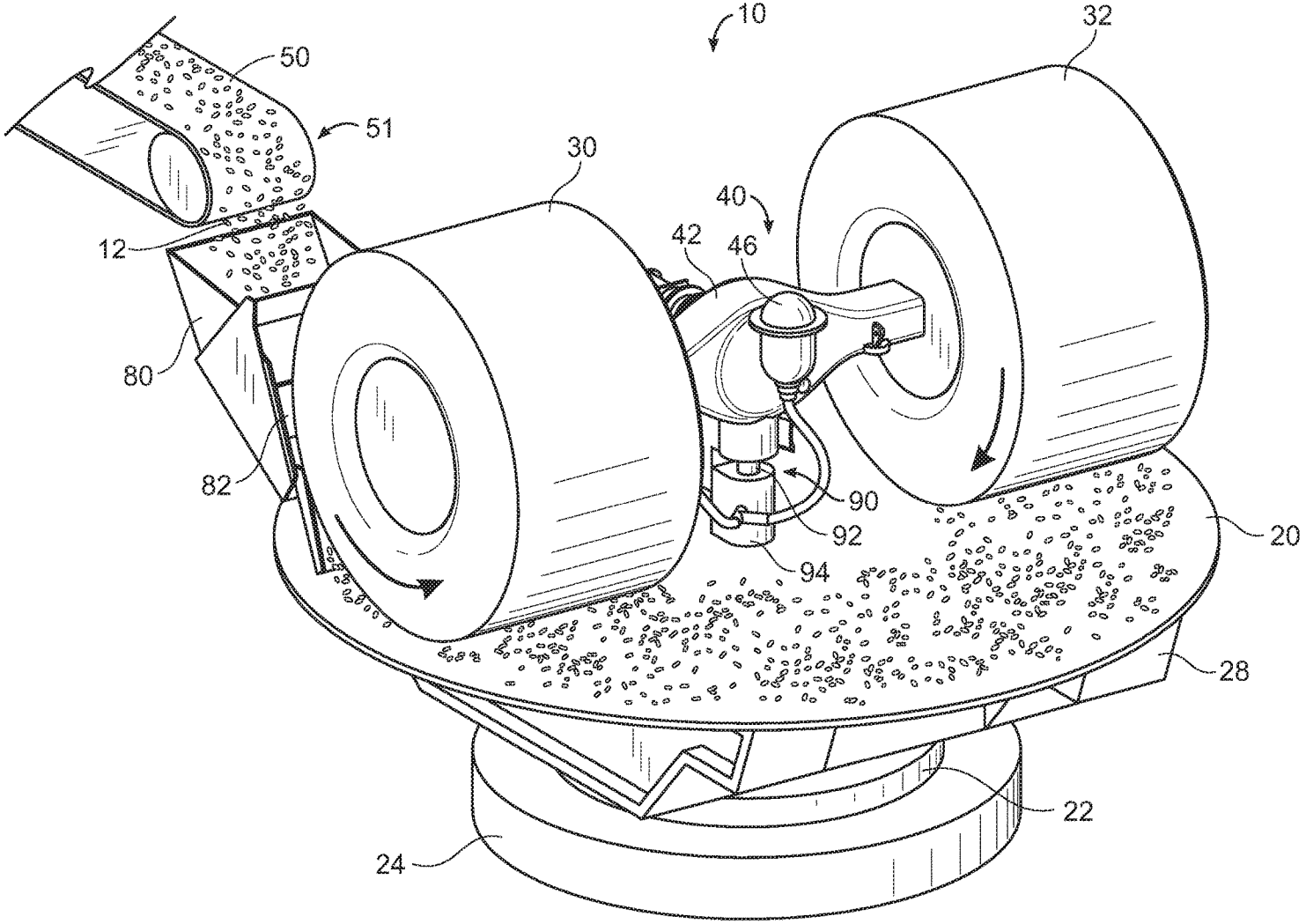
FIG. 1 is a perspective view of a material processing system in accordance with an example embodiment.

A. Overview.

An example material processing system 10 generally comprises a base 24, a table 20 rotationally coupled to the base, a drive assembly 40 coupled to the base 24 by a height-adjustment mechanism 90, and one or more wheels 30, 32 having an outer surface 34, the wheels rotationally mounted on the drive assembly 40 and positionable so that a portion of the outer surface 34 contacts the table 20. The table 20 may be rotationally coupled to the base 24 by a bearing 22, and may further be coupled to the bearing by a table support 28.

Material to be crushed, washed, or otherwise processed by the system 10 will generally be fed to the table 20 by a supply conveyor 50, either directly or via a hopper 80. The system can be fed with rock or any material of a desirable size, which can then be crushed or cleaned (e.g., by having softer materials, coatings, etc. removed from the desired end product by being pressed between the outer surfaces 34 of the wheels and the table 20. After passing under one, two, or more wheels, the processed material can be scraped off the table 20 by a scraper or roller 70, where it can then drop onto an output conveyor 52 for collection or further processing.

In addition to crushing material, the processing system 10 can be used for gold recovery. In such embodiments, the table 20 may comprise a plurality of annular grooves 64. As the table rotates and material, such as pay dirt, is supplied to the table via a conveyor 50 and, possibly, hopper 80, water may also be supplied or sprayed onto the table, for example, via a water supply element, such as water supply tube 60. As the table rotates, the water and pay dirt will be carried over the table 20 from the center to the outer edge, and heavier gold will tend to settle into the grooves 64, while the much lighter portions of the pay dirt (gravel, soil, minerals, etc.) will wash over the grooves and ultimately off the table 20. In this embodiment, the wheels 30 and 32, or at least one of them, may still drive the table, and the wheels will not impede the separation of gold from the pay dirt, although the crushing action of the wheels may not be needed.

Because the crushing action may not be needed for gold recovery, the system in some embodiments may comprise a drive motor 44 below the table 20, supported by a base 24. In such possible embodiments, the wheels 30 and 32 may not be needed to drive the rotation of table 20.

The wheels 30, 32 may be pneumatic, and their "give" may prevent the complete crushing of the material 12 being processed. The wheels 30, 32 may be rotationally driven by the drive assembly 40, and material on the table 20 will be crushed under the wheel or wheels as the table 20 rotates beneath the wheels. The drive wheel 30 will generally cause the rotationally mounted table 20 to rotate underneath the wheels, which may vary in number.

Figure 11:
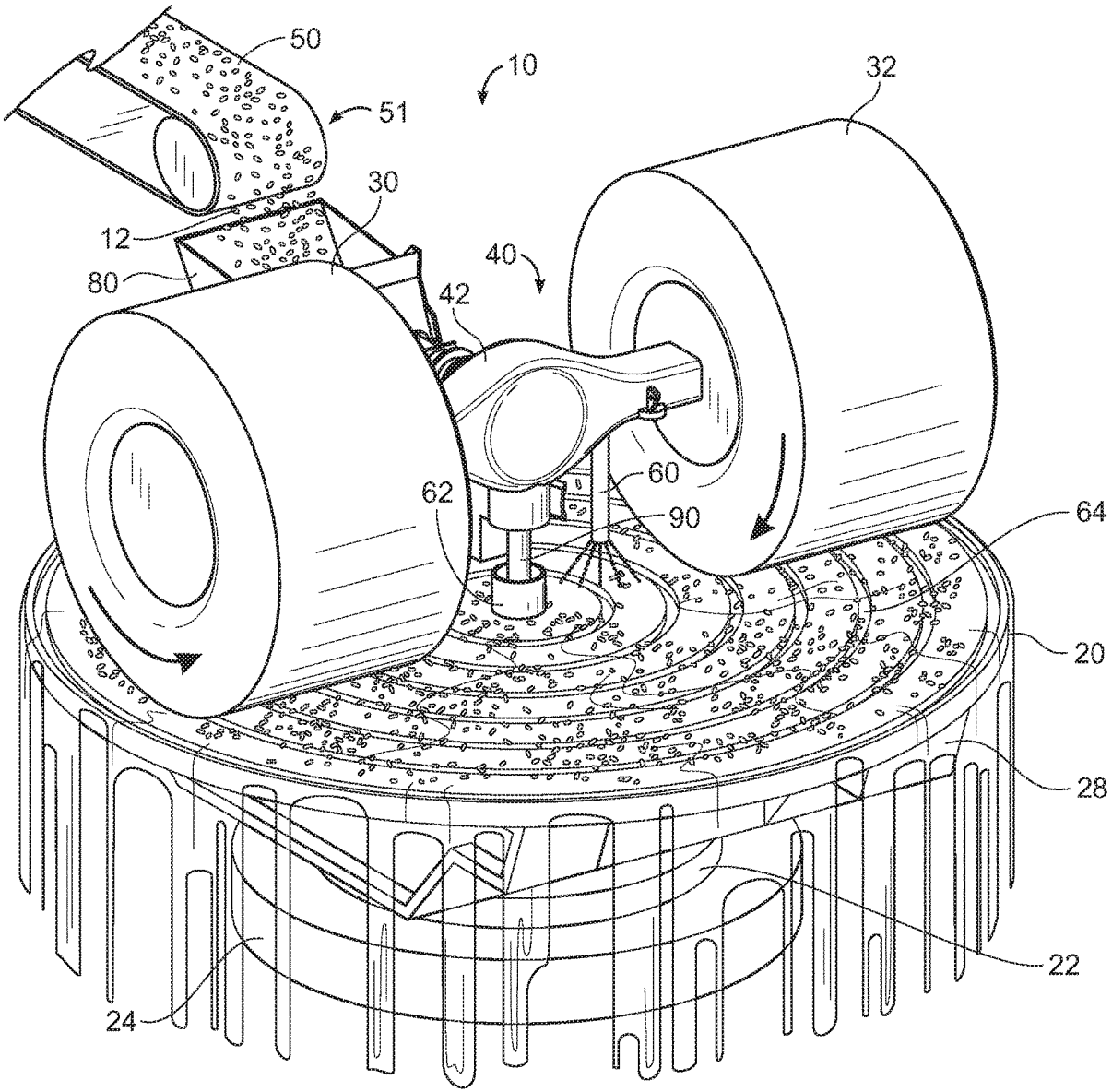
FIG. 11 is a perspective view of a material processing system in accordance with another example embodiment.

In an example embodiment, the rotation of the driven wheel 30 causes the table to rotate. The height-adjusting mechanism 90 may be fixed, as shown in FIG. 11, or may be adjustable to increase a pressure between the wheels 30, 32 and the table 20. For example, the height-adjusting mechanism 90 may comprise a simple rod or strut, or it may comprise a hydraulic cylinder 94, which has a piston 92 coupled or connected to the housing of gearbox 42 of drive assembly 40. The hydraulic cylinder 94 may be actuated to forcefully pull the wheels down onto the table 20, so that when the table rotates under the wheels, material 12 fed onto the table moves under the crushing surface 34 of wheels 30, 32, and is crushed. Adjustment of the downward pressure of the wheels is advantageous because it allows the crushing action to accommodate the type of material 12 being fed to the material processing system 10, preventing waste that could occur by crushing desirable rock under too much pressure, or under unyielding crushing elements (such as hard, non-compliant rollers, etc.).

The height-adjusting mechanism 90 may be, for example, a double-acting hydraulic cylinder 94. In addition to applying large downward forces to the wheels, a double-acting cylinder may be adjustable to lift the wheels off of the table, to allow cleaning and servicing of the material processing system.

The material processing system 10 may further comprise a hopper 80 having a hopper discharge 82 positioned above the table to feed material 12 to the crushing system 10. In this and other embodiments, the system may have a supply conveyor 50 with a conveyor discharge 51, the conveyor discharge 51 positioned above the hopper 80 to supply material 12, such as unprocessed rock, to the hopper.

The apparatus may further comprise a scraper or roller 70 positioned above the table 20 to scrape or force the material 12 off the table after it has passed under the wheel or wheels. As mentioned above, the wheel may comprise a plurality of wheels 30, 32, and one wheel may be driven and other wheels may simply roll on the table 20 as it rotates. The driven wheel or wheels may be rotationally driven by the drive assembly 40, which may include a gearbox 42 and a motor 44, wherein the motor 44 drives one or both wheels through the gearbox 42.

B. Table and Table Support.

Figure 2:
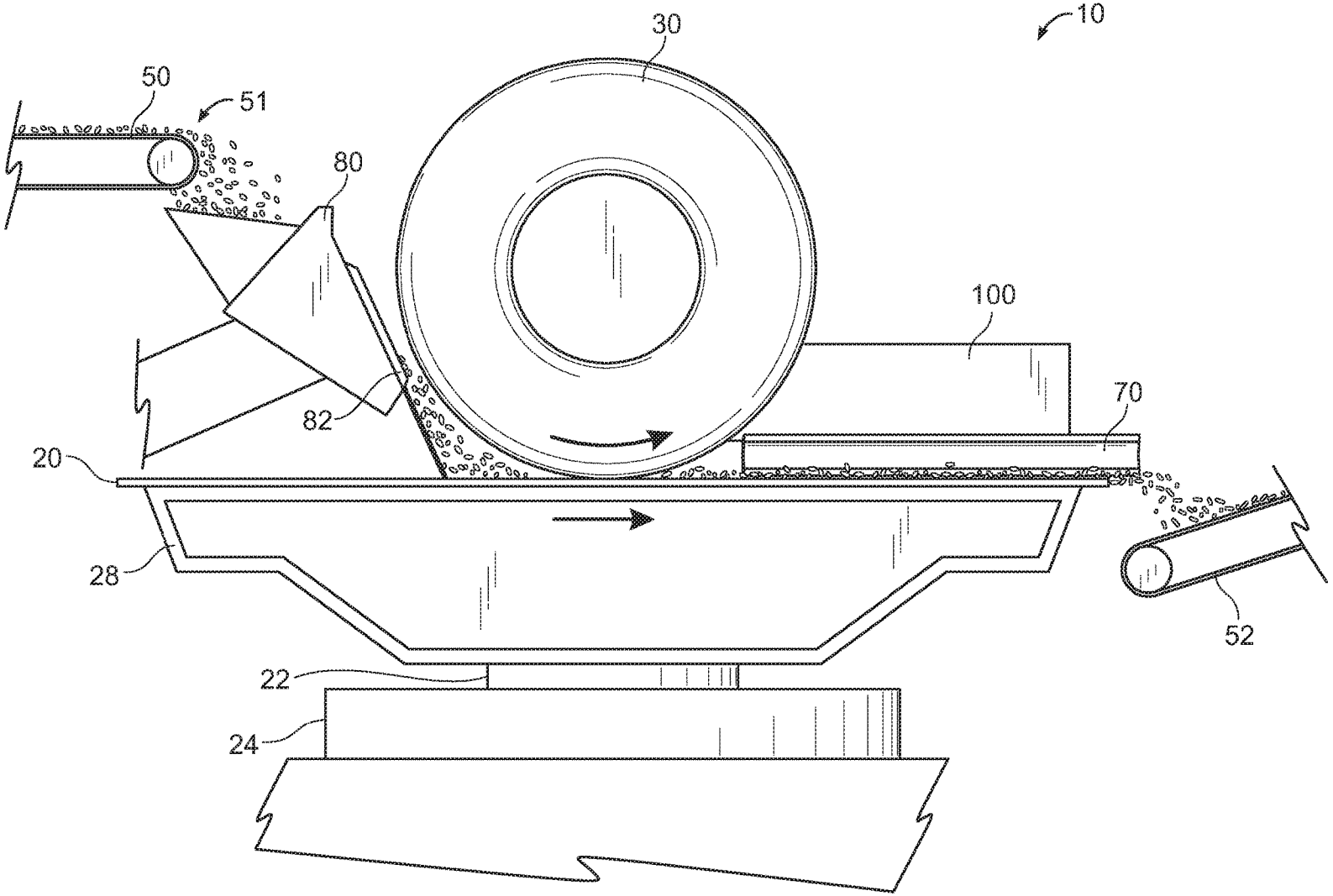
FIG. 2 is a side view of a material processing system in accordance with an example embodiment.
Figure 3:
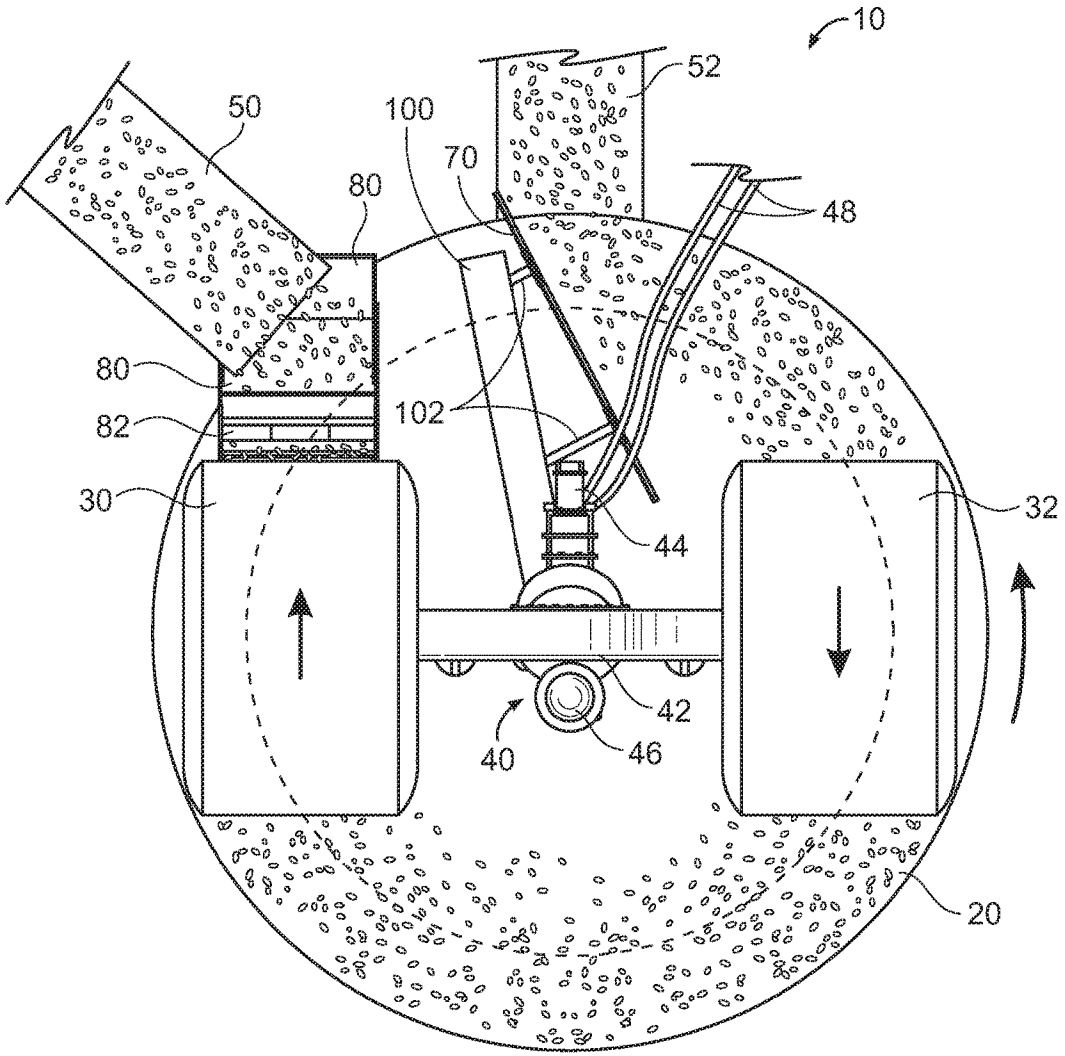
FIG. 3 is a top view of a material processing system in accordance with an example embodiment.

As best shown in FIGS. 1-3, an example material processing system 10 may include a flat table 20 that generally may be a rotating structure, that provides a surface for crushing, refining, or cleaning materials fed to the system. The table 20 may be a relatively thin, flat sheet of material, such as steel, and may further be round, so that the overall shape of the table 20 is that of a disc. However, the table should be thick enough to have considerable strength in order to provide a stable, unbending crushing surface. In one possible embodiment, the table may be circular, and 12 feet in diameter. To aid in rigidity, the table may be securely attached to, and supported by, a table support 28, as shown in FIG. 2, as one possible example. The table support 28 may be engineered for high strength and rigidity, so that the table 20 and support 28 provide a very stable, rigid rotating surface for crushing any material under rotating wheels 30, 32.

The table 20 may be generally horizontal, and may further be held in position parallel to, and above, a fixed base 24, upon which the entire material processing may rest. Alternatively, the table 20 may be tilted if desired, for example, if a user finds it desirable to used water in the crushing/cleaning process to further process or clean the material being fed to the system 10. If water is used, tilting the table 20 may allow the water to drain off the table surface at a particular location.

In other embodiments, the upper surface of the table may not be perfectly flat, but may instead be contoured or shaped to keep any crushed or raw materials under the wheels and away from the center or extreme outside edge of the table, for example. Since they will generally rotate under the wheels, the table 20 and table support 28 may be supported by a large, ring-shaped bearing 22, which may be similar to the swing bearing of an excavator. The bearing 22 allows the table 20 and table support 28 to rotate freely while still being rotationally coupled to a stable base 24, which supports the bearing 22 and the entire material processing system 10.

Figure 5:
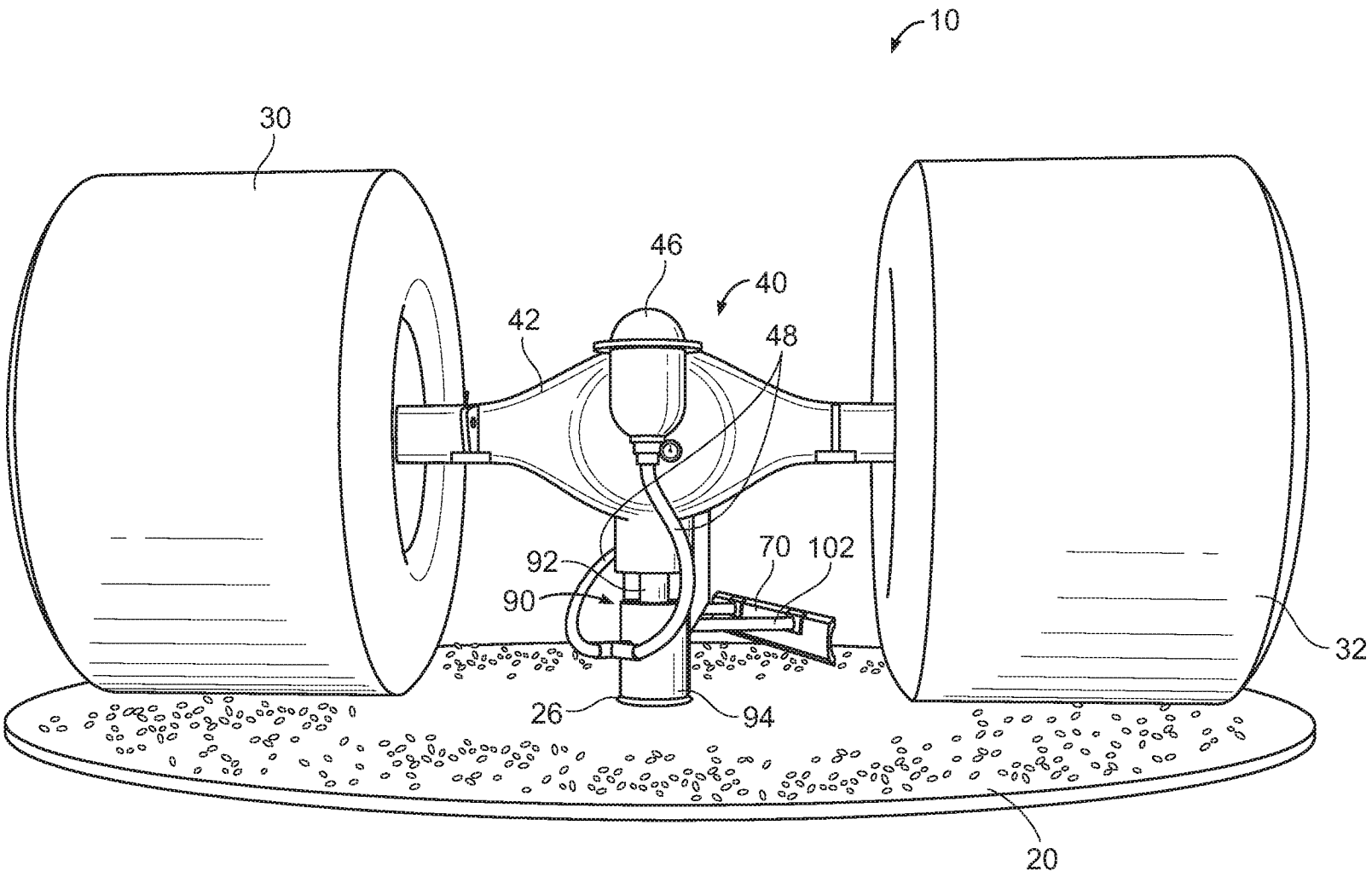
FIG. 5 is a partial perspective view of a material processing system in accordance with an example embodiment.
Figure 8:
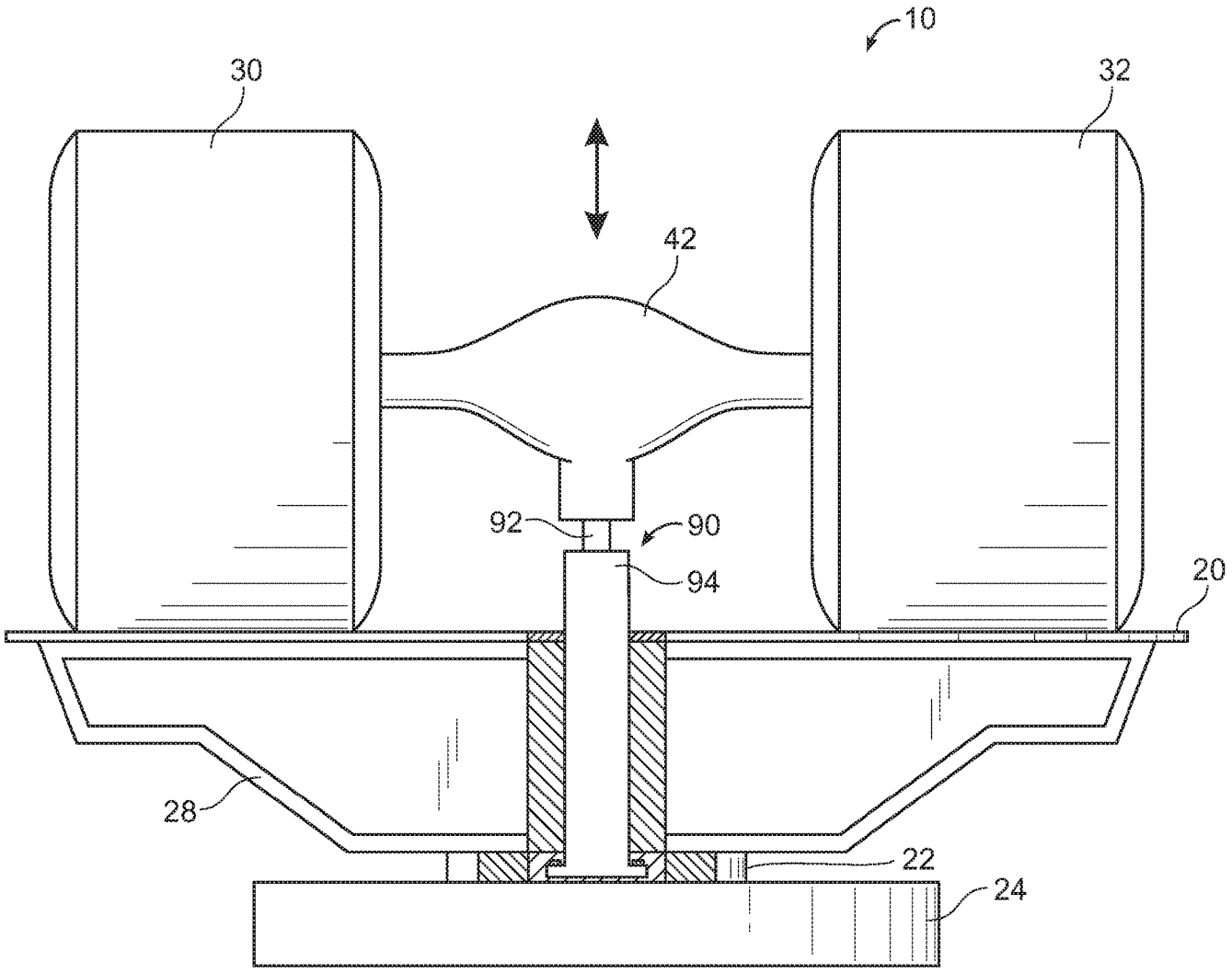
FIG. 8 is a partial side view of a material processing system in accordance with an example embodiment.

The table 20 may also include a central opening 26. As shown in FIGS. 5 and 8, a height-adjusting mechanism 90, such as a hydraulic cylinder 94, may extend upwardly through the central opening 26. The central opening 26 allows the height-adjusting mechanism 90 to support the wheels and drive assembly, as well as other structures, above the table 20. Because the height-adjusting mechanism 90 is not attached to the table 20 or the table support 28, it does not necessarily rotate with the table 20. Height-adjusting mechanism 90 may be mounted securely, such as by welding, to the base 24. The height-adjusting mechanism 90 may be used to adjust the height of wheels 30, 32 above the table 20, if necessary, while the table 20 has a fixed position and distance above the base 24.

Figure 13:
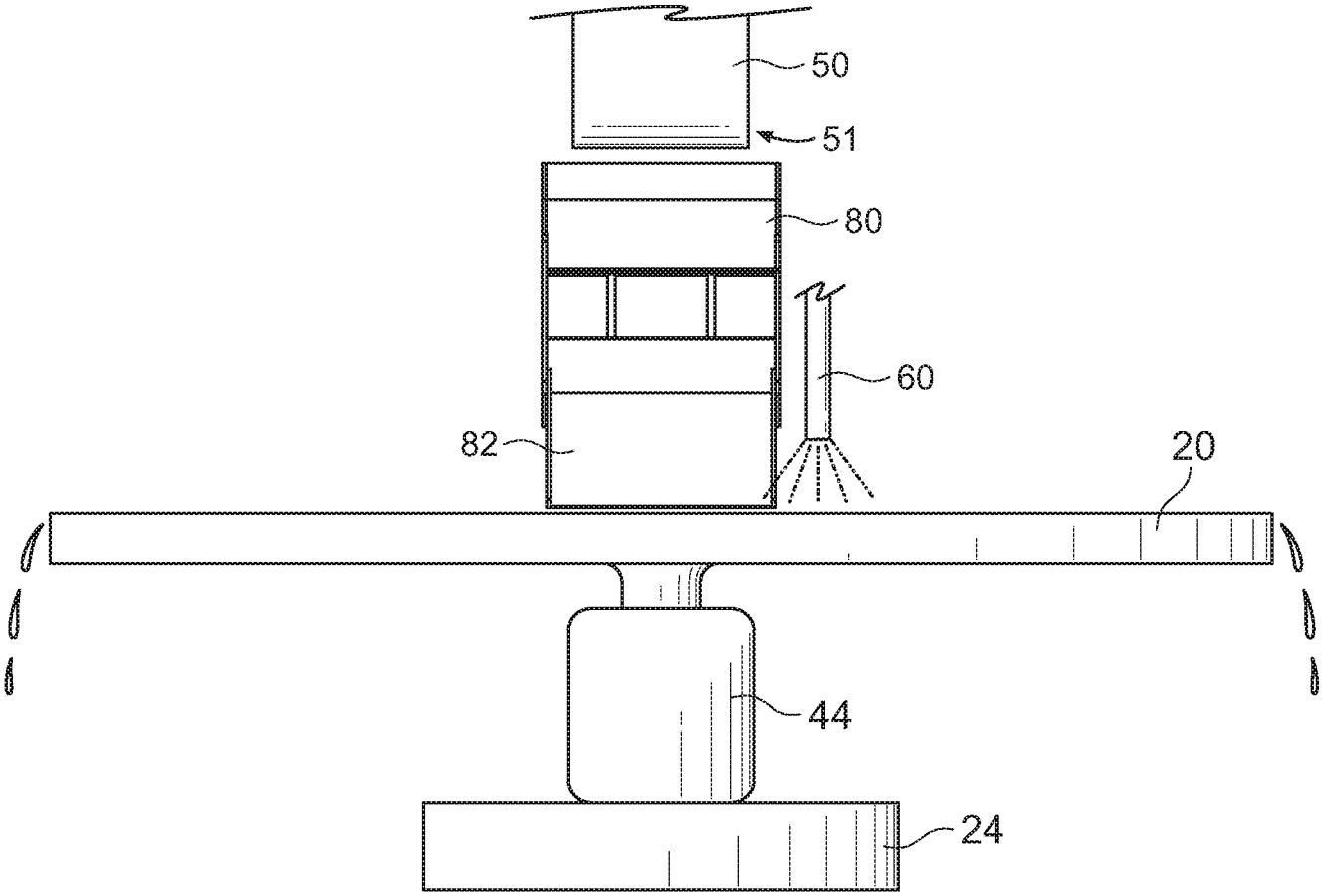
FIG. 13 a partial side view of a material processing system in accordance with another example embodiment.

In still other embodiments, the upper surface of the table may include a plurality of annular grooves 64, which may be useful for washing gold out of pay dirt, as shown, for example, in FIGS. 11 and 13. In an example embodiment, the grooves may be square in profile and may further be about ½ inch deep and be spaced about 3 inches apart along the surface of table 20. It will be appreciated, however, that these dimensions are not necessarily critical, and other groove profiles may be used to catch gold. In this embodiment, conveyor 50 and hopper 80 may be positioned closer to the center so that pay dirt will be washed over more of the annular grooves 64, as shown in FIGS. 11 and 13. As the table rotates and material, such as pay dirt, is supplied to the table via conveyor 50 and, possibly, hopper 80, water may also be supplied or sprayed or poured onto the table, for example, via water supply tube 60. A collar 62, which may be in the form of a hollow tube, can be used to prevent water from entering the central opening of the table in some embodiments.

As the table rotates, the water and pay dirt will be carried over the table 20 from the center to the outer edge, due to the table's rotation, and the heavier gold will tend to settle into the grooves 64, while the much lighter portions of the pay dirt (gravel, soil, minerals, etc.) will be washed over the grooves by the water and ultimately carried off the table 20.

In one possible embodiment including annular grooves (e.g., as shown in FIG. 11), the wheels 30 and 32, or at least one of them, may still drive the table, and the wheels will not impede the separation of gold from the pay dirt, although the crushing action of the wheels may not be needed. Further, in this embodiment, the height-adjusting mechanism 90 may not need to vary the distance, or apply varying force, between the wheels 30, 32 and the table 20; accordingly, the mechanism 90 may be a simple structure, such as a rod or strut.

Because the crushing action may not be needed for gold recovery, the system in some embodiments may comprise a drive motor 44 below the table 20, supported by a base 24, as shown in FIG. 13. In such possible embodiments, the wheels 30 and 32 are not needed to drive the rotation of table 20.

C. Wheels.

As best shown in FIGS. 1-3, an example material processing system 10 may also include one or more wheels, for example, two wheels 30, 32. As shown, the wheels may be large, pneumatic wheels with a substantially flat surface 34 for crushing material 12 between the wheels and the table 20. In an example embodiment, the wheels may be or comprise two 6-foot diameter, 30" wide rubber wheels set atop table 20, rotating in opposite directions. In one possible example embodiment, wheel 30 may be a drive wheel that is driven by drive assembly 40, while wheel 32 may be a non-driven wheel that is mounted on the same axis as wheel 30, but as indicated, is not driven by drive assembly 40. This example configuration may be desirable and easier to implement than others, since the two wheels will rotate in different directions as the table 20 rotates under them. Thus, drive wheel 30 itself causes table 20 to rotate on its bearing 22, due to its contact with the table.

Figure 12:
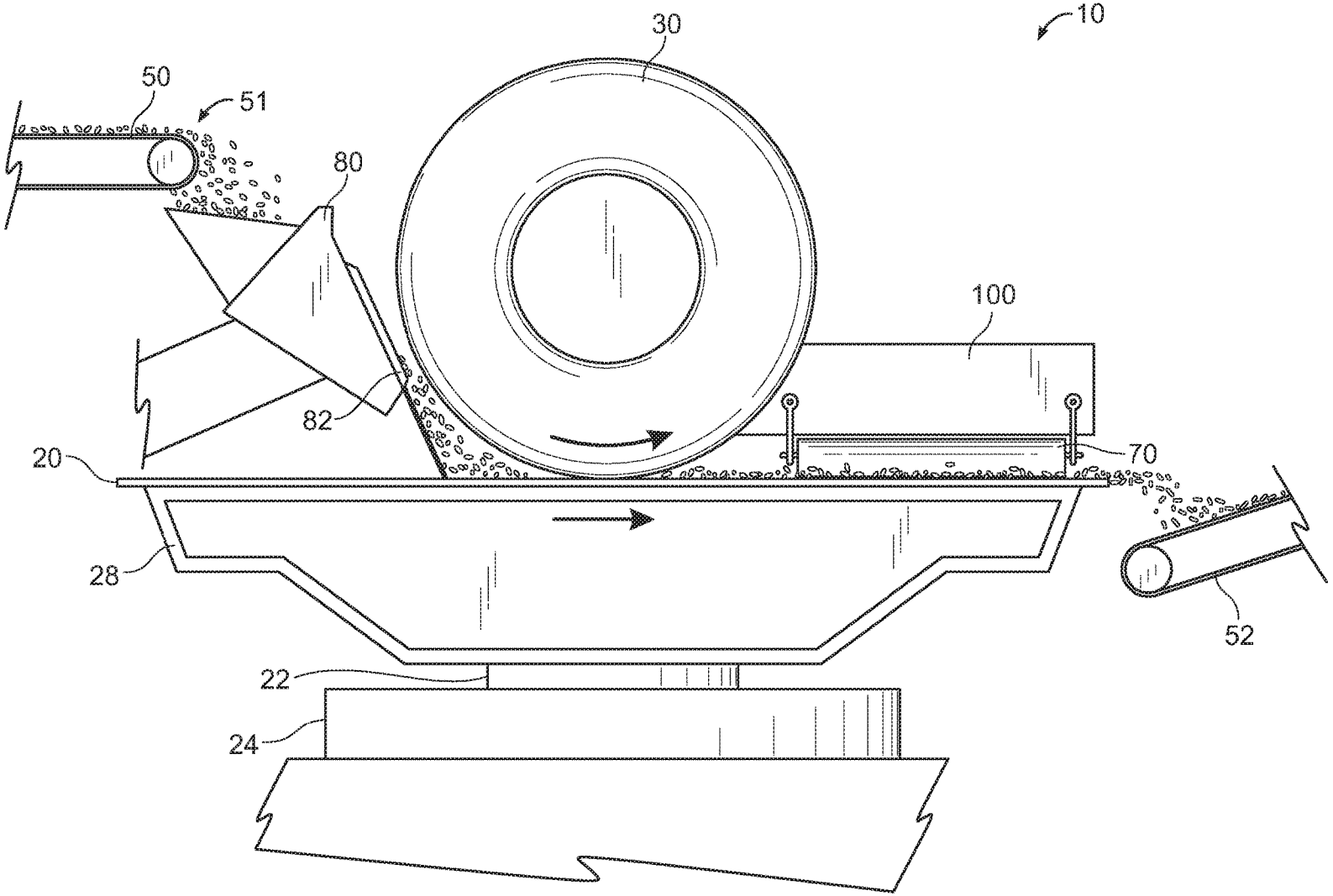
FIG. 12 is a side view of a material processing system in accordance with another example embodiment.

Wheel 32, in turn, may be driven by the table 20 rotating beneath it, again due to contact between the surface 34 of wheel 32 with the top of the table. Material, such as unprocessed rock, to be crushed, can be fed onto table 20 directly in front of either wheel 30 or 32, since either wheel will perform the function of crushing and cleaning the material. The system 10 can be generally configured so that material will pass under two wheels, as best shown in FIG. 3, before scraper/roller 70 forces it onto output conveyor 52 after it has been processed. An embodiment with a scraper is shown in FIGS. 2 and 3, and an embodiment with a roller 70 is shown in FIG. 12.

Figure 6:
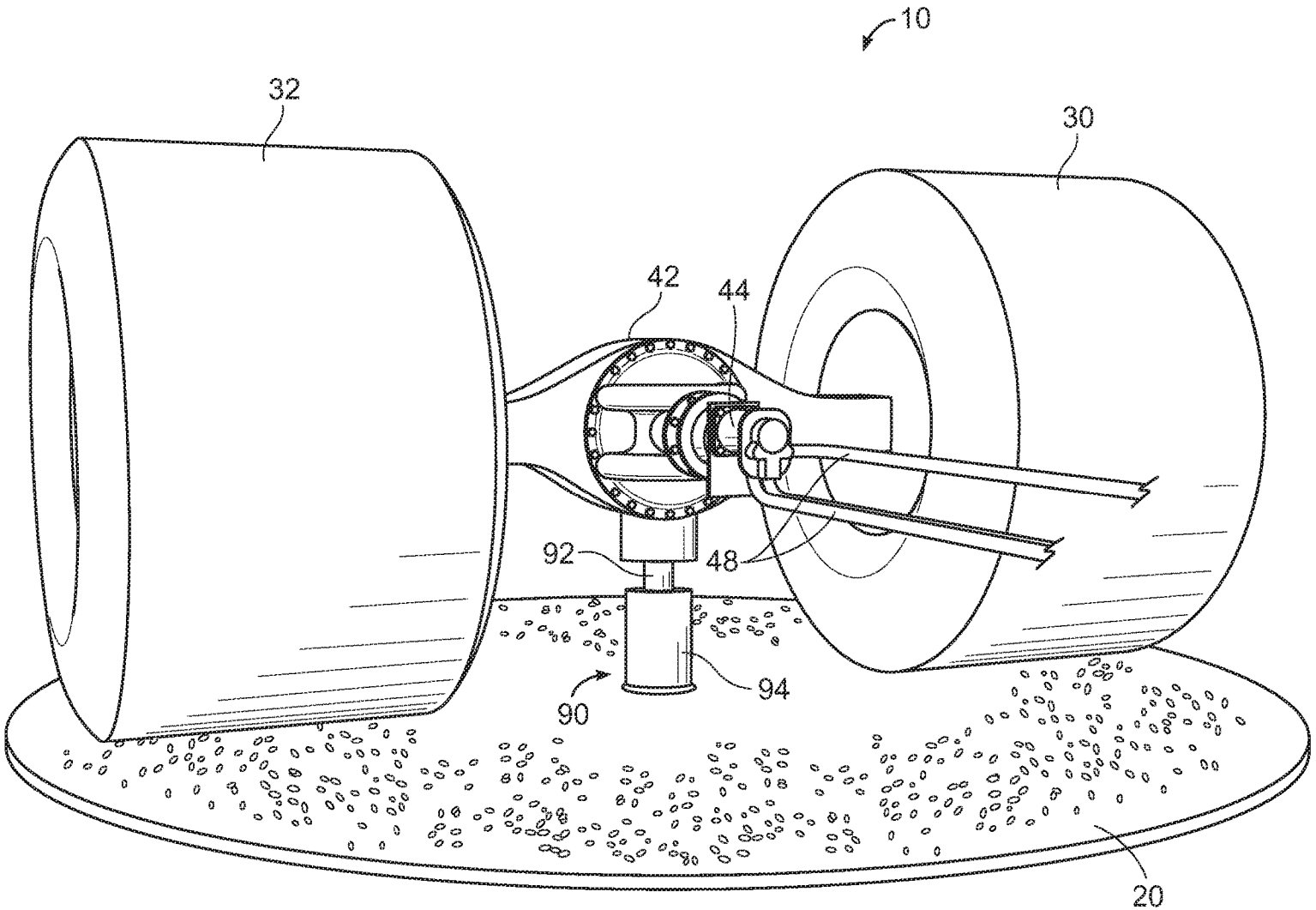
FIG. 6 is another partial perspective view of a material processing system in accordance with an example embodiment.
Figure 7:
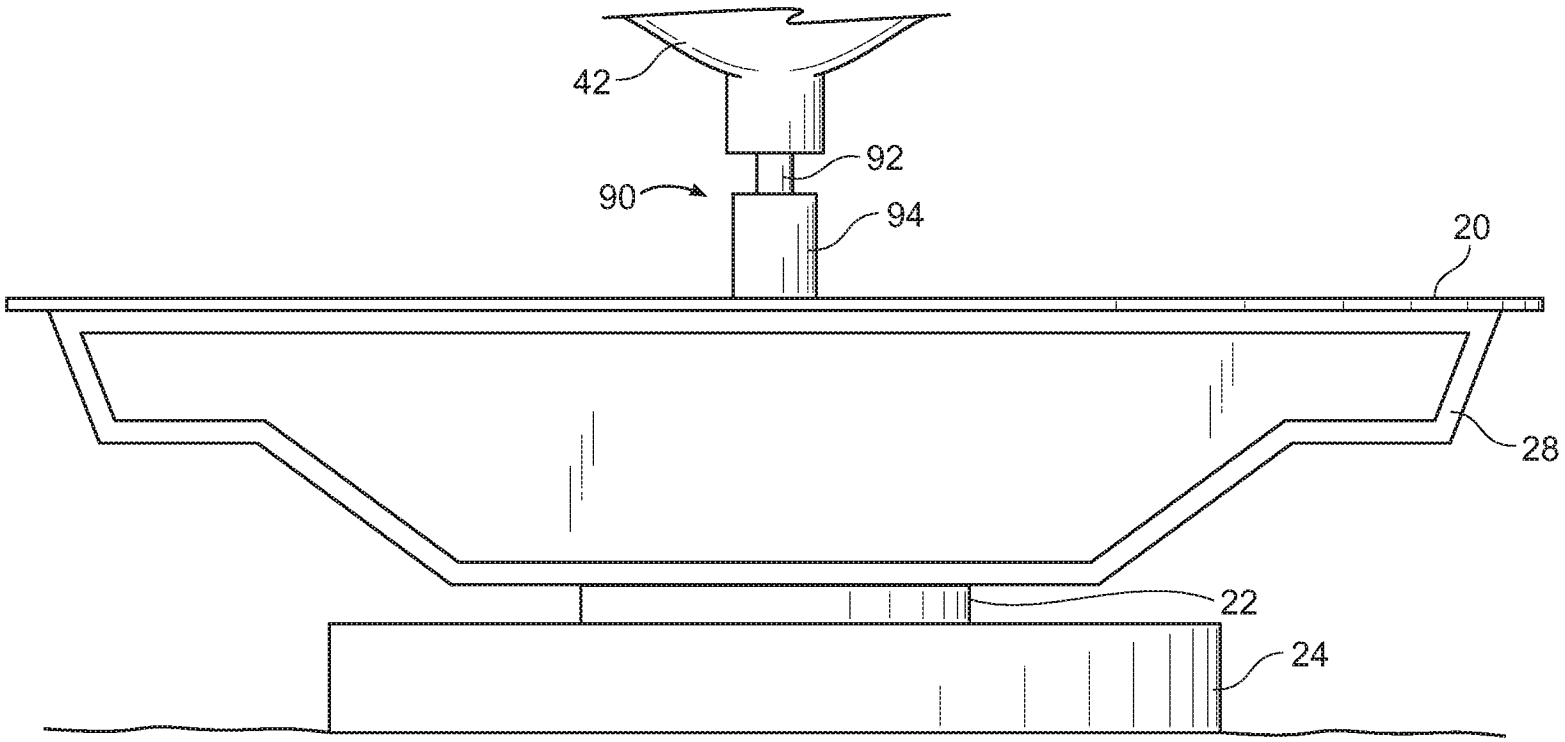
FIG. 7 is a partial side view of a material processing system in accordance with an example embodiment.

As also shown in FIG. 3, wheel 30 can be driven by drive assembly 40. The drive assembly 40 may comprise a motor 44, which may be a hydraulic motor, although an electric motor may also be used. If a hydraulic motor 44 is used, it may be supplied with hydraulic power by hydraulic lines 48. The drive configuration is also shown in FIG. 6, which illustrates how hydraulic lines 48 can be routed to the motor 44 between the wheels, which is an advantage of the wheels being stationary as shown, while the table 20 rotates about a vertical axis under the wheels. FIG. 6 also shows how the height adjusting mechanism 90, specifically comprising cylinder 94 and piston 92 in this example embodiment, support and serve as a secure mount for the gearbox 42 as well as the wheels 30 and 32.

As mentioned above, it is possible for the hydraulic motor to be coupled to wheel 30 through a gearbox or differential 42, which may drive the single wheel 30. Gearbox 42 may be coupled at its lower side or end to piston rod 92 of hydraulic cylinder 94. Thus, hydraulic cylinder 94 and piston rod 92 can comprise height-adjusting mechanism 90, which controls the height, and accordingly the pressure, of wheels 30, 32 above the upper surface of table 20. Cylinder 94 can be a double-acting cylinder, and can be large, capable of applying 130,000 pounds of downward force, or more, to drive assembly 40, to create large crushing forces applied by the wheels 30, 32.

D. Height-Adjusting Mechanism.

As best shown in FIGS. 5 and 7-9, an example material processing system may include a height-adjusting mechanism 90. As shown, one possible embodiment of the mechanism is a double-acting hydraulic cylinder 94. As also shown in FIG. 8, the base end of cylinder 94 may be securely attached to base 24, in the center of the material processing system 10. The cylinder 94 may be welded or bolted to the base 24, and may extend through the center of bearing 22, and through the open center of table support 28 and the central opening 26 of table 20 (see also FIG. 5). Since the cylinder 94 is solidly mounted to the base 24, and since it does not rotate along with table 20 during operation, the cylinder 94 may also be used as an attachment point for scraper or roller 70 and also hopper 80, although those components may also be secured to a structure or structures beyond the outer edge of table 20 if desired or necessary.

As an example, a support arm 100 may be welded, bolted, or attached by other means to cylinder 94, and can in turn hold scraper/roller 70 in a desired position in contact with table 20, so that, as table 20 rotates, crushed rock that has passed under wheel 32 (FIG. 3) is forced off the table 20 and onto output conveyor 52 for screening, storage, etc. The scraper 70 may be offset from, and attached to, the support arm 100 by struts 102, as also shown in FIG. 3. The scraper or roller 70 may be mounted so that its position, angle, and height can be adjusted as desired, with respect to the surface of table 20.

In order to stabilize and maintain a constant pressure and thus grinding force, cylinder 94 may be supplied with hydraulic pressure via a hydraulic accumulator 46, which, as is known, can reduce or eliminate pressure variances in hydraulic lines, such as lines 48, due to fluctuations at the source. In order to create large forces if necessary, the height-adjusting mechanism, and specifically cylinder 94 and piston rod 92, are attached to the drive mechanism 40 via gearbox 42, and can create tremendous downward pressure if needed. For example, it is possible for cylinder 94 and piston rod 92 to pull gearbox 42 down toward table 20 with as much as 130,000 pounds of force or more. This force is adjustable, which allows the crushing action of the system 10 to also be adjusted depending on the material being processed and the desired results.

Figure 9:
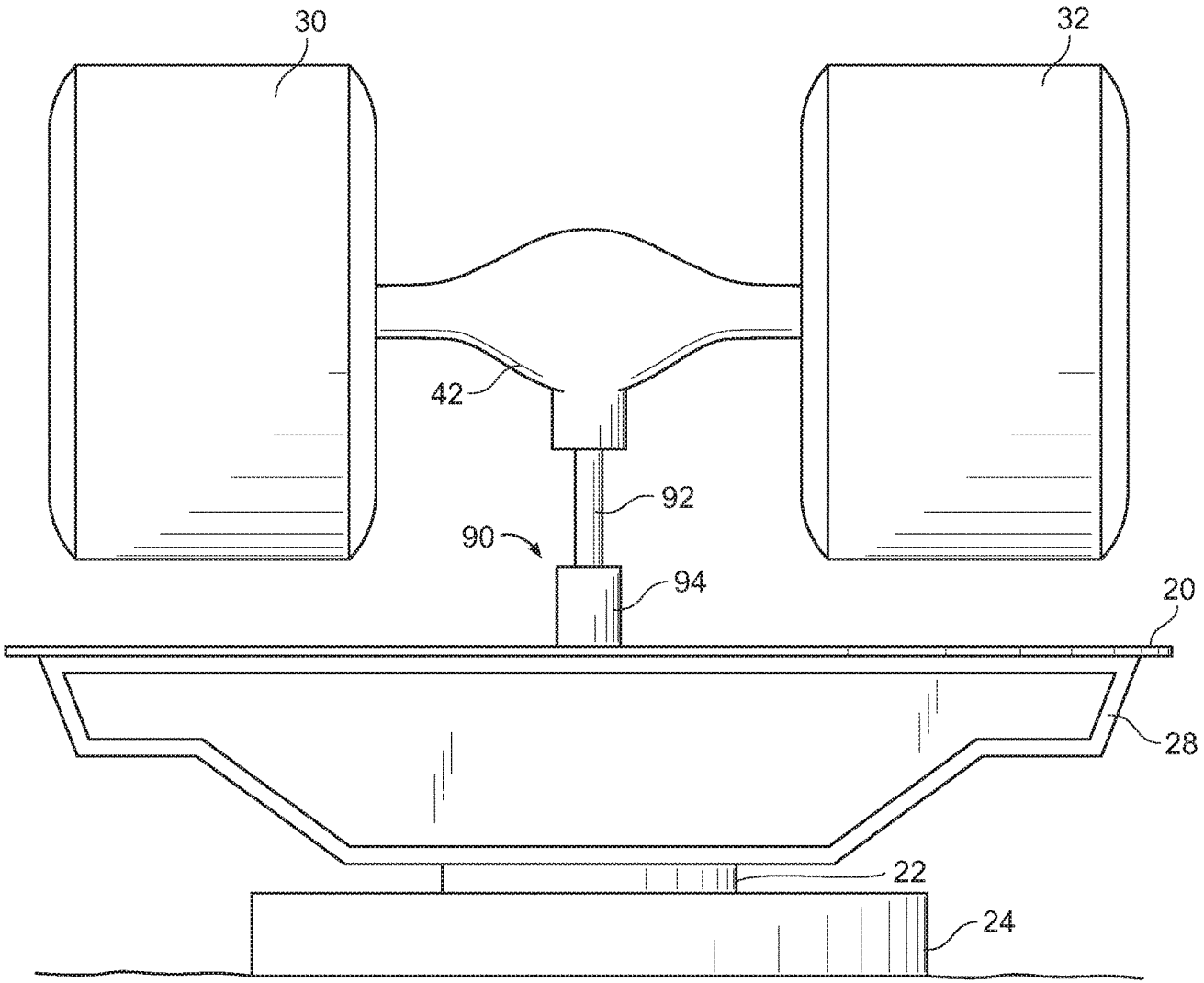
FIG. 9 a partial side view of a material processing system in accordance with an example embodiment.

In addition to supplying downward force, the mechanism 90 can also be used to raise the wheels and the drive assembly 40 a substantial height above their normal operating position as shown in FIG. 9, which allows for access to the wheels and table 20 for cleaning, maintenance, etc.

If two or more wheels are used, it can be readily seen that a balanced, downward crushing force will be applied by each wheel due to the height-adjusting mechanism being located in the center, or approximate center, of the wheels. Further, use of multiple wheels may prevent an uneven load from being applied to the bearing 22, which might otherwise cause it to wear prematurely.

E. Operation of Preferred Embodiment.

In use, the material processing system 10 may be located on-site where rock or other material is to be processed. One possible use of the system is to crush or otherwise process rock or material 12 to be used as an aggregate in the concrete industry. As discussed further below, another use of the system is gold recovery—separating gold from pay dirt. Use of the system allows impurities to be removed from the desired rock. Using rubber, pneumatic wheels in contact with metal allows for the elimination of soft rock and impurities from the rock without further crushing rock that is already of desirable size and hardness. This is possible by adjusting the downward pressure applied by the wheels to the material 12 between the wheels and the table 20, and also because of the compliance or give of the rubber, pneumatic tires. Thus, the system reduces the loss of hard rock and eliminates the soft, undesirable rock, irregularly shaped rock, and other materials from the final product.

Material 12 to be processed by the system is first fed to the table 20 just in front of wheel 30 or 32. The material may be fed directly by a conveyor 50 having a discharge end 51, or alternatively, the discharge end 51 of the conveyor may be positioned over the open end of hopper 80, as shown in FIG. 1, which has a hopper discharge 82 to drop material 12 in front of wheel 30 or 32, onto table 20. The hopper discharge 82 may be a simple, fixed opening at the bottom of the hopper, or it may be a slide gate, which would allow for some regulation of the rate at which material 12 is fed into the system, in addition to the rate controlled by the speed at which conveyor 50 is run.

Figure 4:
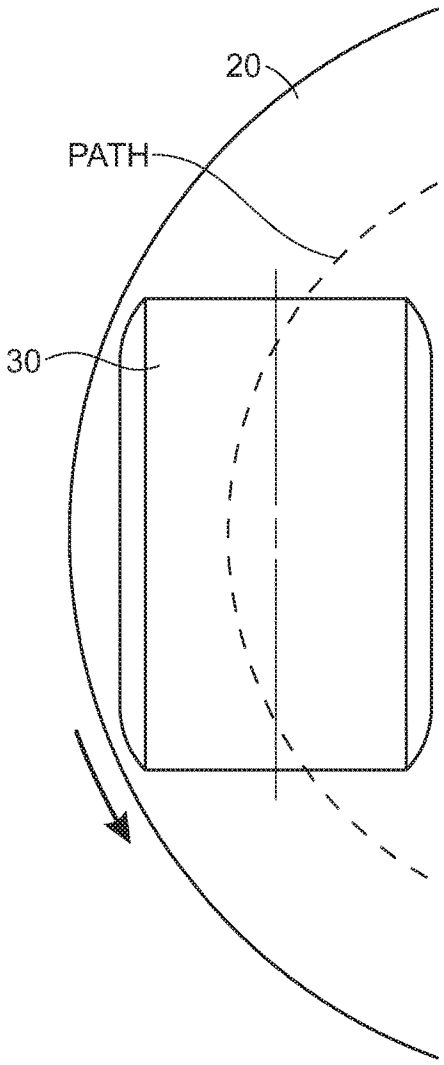
FIG. 4 is a partial top view of a material processing system in accordance with an example embodiment.

Once the material 12 is dropped in front of wheel 30, the rotation of the table toward the wheel carries it under the wheel, where the material 12 is between the outer surface 34 of wheel 30 and the top surface of table 20. Due to the downward force of the wheels 30 and 32, the material 12 is crushed between the compliant wheels and the table. As shown in FIG. 4, the normal path of a point on the table 20 differs from the centerline of wheel 30. The same is true for wheel 32. In other words, because the path denoted in FIG. 4 is not linear, the crushing action differs from that of a wheel simply rolling over a rock on a stationary surface, such as a rock on a road. Instead, a scrubbing action is introduced, which aids the crushing process. Upon observing the crushing process and the processed material, the downward pressure of the wheels on the table can be adjusted by changing the hydraulic pressure supplied to cylinder 94 via hydraulic accumulator 46, so that the rock is not crushed too much, which can result in loss of good, hard rock of proper size.

The crushing process, again with the compliant wheels 30, 32 and the scrubbing action, tends to crush any soft rock that is mixed in with the desired rock, which may be suitably hard rock such as rock 1" or smaller in its largest dimension. Softer materials such as shale, iron oxide, coal, soft particles, and other material, as well as soft material on the surface of hard rocks, is eliminated by the crushing system 10. In addition, elongated pieces of rock will be crushed due to their shape. These soft materials or elongated pieces are considered to be impurities, and are undesirable, for material used as an aggregate in concrete, for example, although other uses for the material processing system are possible as well. By not over-processing the material, loss of good rock can be reduced or eliminated. Furthermore, use of the material processing system 10 may eliminate or reduce the need for further processing of the rock, such as using a wash plant in addition to pulverization, and the need to run material through a jig after a wash plant is used.

Once material 12 has passed under wheel 30, it continues to move around the rotating table 20 until it reaches wheel 32, where it undergoes further crushing, with the same effect as discussed above, further crushing soft materials and cleaning the hard rock of any substance on its surface. As the material 12 emerges from under wheel 32, it will typically be a mixture of gravel and powder, dust, etc. The material at this point will be carried by the table's rotation into contact with scraper/roller 70, which may be positioned at an angle to the natural path of the material on the table surface, so as to urge the material toward the outside edge of the table 20, and eventually, off the edge.

Figure 10:
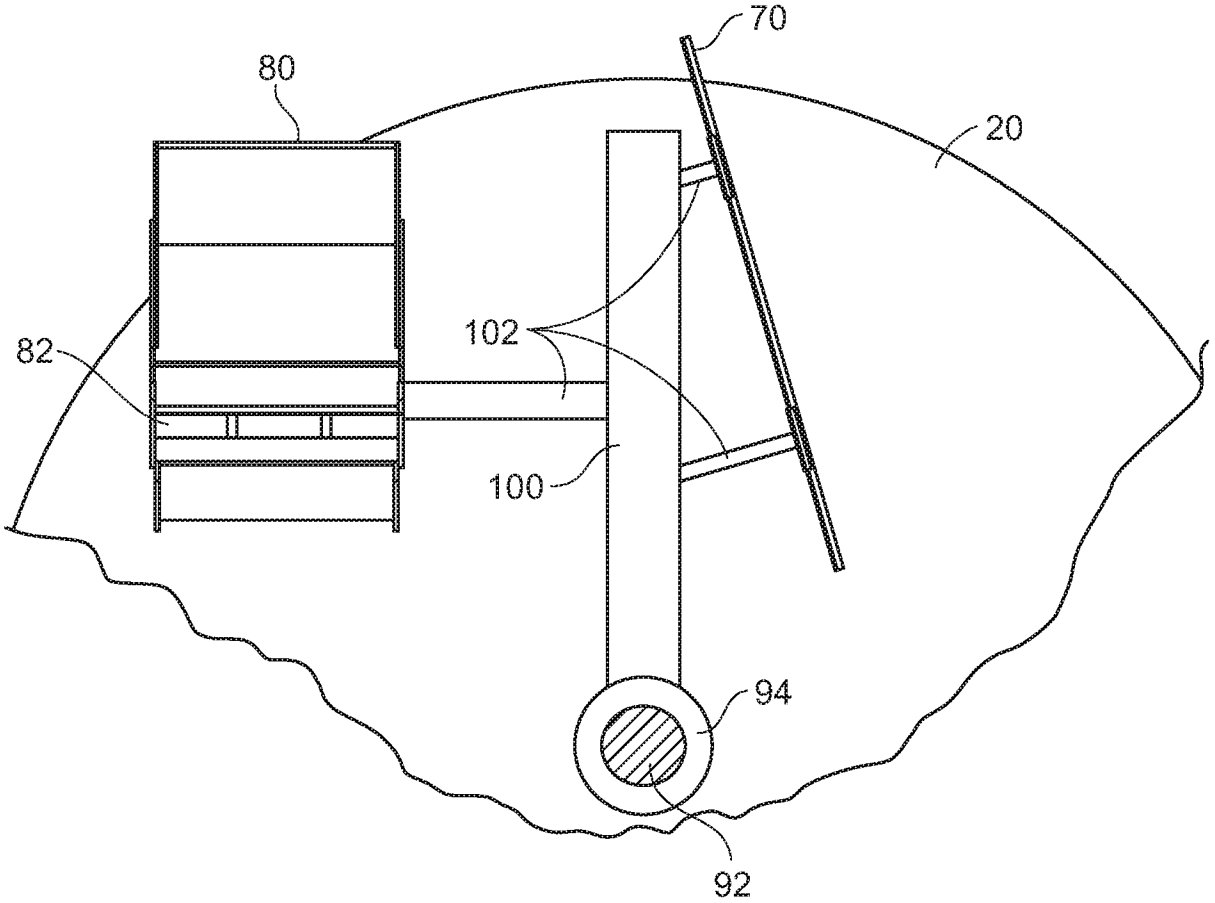
FIG. 10 is a partial top view of a material processing system in accordance with an example embodiment.

As shown in FIG. 10, the scraper or roller 70 may be mounted on the cylinder 94 via a support arm 100 and struts 102. If a roller 70 is used, it may be mounted with pivots on its ends (not shown). Since cylinder 94 does not move vertically or rotate, it can provide a stable base above table 20 for mounting the scraper/roller 70, hopper 80, support arm 100, etc. Further, because the table 20, rather than the wheels, rotates about a central vertical axis, hydraulic lines and any other equipment can reach the central portion of the material processing system between the wheels, as needed, without interference from wheels moving around the table.

After crushing, the material 12 can be allowed to fall off the edge of table 20 and into a pile, or it can be run through one or more screens to separate it by size—for example, to allow dust and smaller particles to fall through a screen while the larger pieces pass over the screen. As shown in FIG. 3, before it is separated, all the material can simply be urged off of the table 20 and onto the top surface of an output conveyor 52 for further processing (e.g., separation by size) or simply piling near the conveyor discharge.

As mentioned above, the material processing system 10 may be used for gold recovery—separating gold from pay dirt, rather than crushing and separating rocks from softer materials. In such example embodiments, the upper surface of the table may include a plurality of annular grooves 64, as shown, for example, in FIGS. 11 and 13. In an example embodiment, the grooves may be square in profile and may further be about ½ inch deep and be spaced about 3 inches apart along the surface of table 20, although these dimensions are not necessarily critical, and other groove profiles may be used to catch gold. In this embodiment, conveyor 50 and hopper 80 may be positioned closer to the center of the table 20 so that pay dirt will be washed over more of the annular grooves 64. Water may also be supplied or sprayed onto the table, for example, via water supply tube 60, the water being used to wash and separate lighter material from the gold, which will tend to fall into the annular grooves, and stay there. A collar 62, which may be in the form of a hollow tube, can be used to prevent water from entering the central opening of the table in some embodiments.

Unless otherwise defined, all technical and scientific terms used herein have the same meaning as commonly understood by one of ordinary skill in the art to which this invention belongs. Although methods and materials similar to or equivalent to those described herein can be used in the practice or testing of the material processing system 10, suitable methods and materials are described above. All publications, patent applications, patents, and other references mentioned herein are incorporated by reference in their entirety to the extent allowed by applicable law and regulations. The material processing system 10 may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A material processing apparatus comprising:

a base;

a table rotationally coupled to the base, the table comprising a central opening, wherein the table is positioned above the base;

a drive assembly coupled to the base by a height-adjustment mechanism, the height-adjustment mechanism extending through the central opening; and a wheel having an outer surface, the wheel rotationally mounted on the drive assembly and positionable so that a portion of the outer surface contacts the table such that rotation of the wheel causes the table to rotate;

wherein the wheel is rotationally driven by the drive assembly, and wherein material on the table will be crushed under the wheel as the table rotates.

2. The material processing apparatus of claim 1, wherein the wheel comprises rubber.

3. The material processing apparatus of claim 1, wherein the height-adjusting mechanism is adjustable to increase a pressure between the wheel and the table.

4. The material processing apparatus of claim 3, wherein the height-adjusting mechanism comprises a hydraulic cylinder.

5. The material processing apparatus of claim 4, wherein the height-adjusting mechanism comprises a double-acting hydraulic cylinder.

6. The material processing apparatus of claim 5, wherein the height-adjusting mechanism is adjustable to lift the wheel off of the table.

7. The material processing apparatus of claim 1, wherein the table is rotationally coupled to the base by a bearing.

8. The material processing apparatus of claim 7, wherein the table is coupled to the bearing by a table support.

9. The material processing apparatus of claim 1, further comprising a hopper having a hopper discharge positioned above the table to feed material to the material processing apparatus.

10. The material processing apparatus of claim 9, further comprising a conveyor having a conveyor discharge, the conveyor discharge positioned above the hopper to supply material to the hopper.

11. The material processing apparatus of claim 1, further comprising a roller positioned above and in close proximity to a surface of the table to force the material off the table after it has passed under the wheel.

12. The material processing apparatus of claim 1, wherein the drive assembly comprises a motor and a gearbox, the gearbox coupling the motor to the wheel.

13. The material processing apparatus of claim 1, further comprising a second wheel having an outer surface, the second wheel rotationally mounted on the drive assembly and positionable so that a portion of the outer surface contacts the table.

14. The material processing apparatus of claim 13, wherein the plurality of wheels comprises two wheels, and wherein one of the wheels is not driven by the drive assembly.

15. The material processing apparatus of claim 13, wherein the height-adjusting mechanism is adjustable to increase a pressure between the plurality of wheels and the table.

16. A material processing apparatus comprising:

a base;

a table rotationally coupled to the base, the table comprising a center, an outer edge, an upper surface, and a plurality of annular grooves in the upper surface;

a drive assembly coupled to the base to rotate the table;

a water supply tube to supply water to the upper surface of the table; and a conveyor having a conveyor discharge, the conveyor discharge positioned above the table proximate the center to supply material to the table;

wherein water from the water supply tube carries the material over the plurality of annular grooves from the center toward the outer edge as the table rotates; and wherein the upper surface is flat, such that the water can flow over the grooves and off the outer edge of the table, wherein the drive assembly is coupled to the base by a height-adjustment mechanism: the apparatus further comprising: a wheel having an outer surface, the wheel rotationally mounted on the drive assembly and positionable so that a portion of the outer surface contacts the table; wherein the wheel is rotationally driven by the drive assembly, and wherein the wheel will cause the table to rotate under the wheel as the wheel rotates.

17. The material processing apparatus of claim 16, wherein the wheel comprises rubber.

18. The material processing apparatus of claim 16, wherein the drive assembly comprises a motor mounted between the base and the table.

* * * * *